United States Patent [19]

Matson

[11] 4,449,644

[45] May 22, 1984

[54] BLAST AERATOR FOR FLUIDIZING GRANULAR MATERIAL

[75] Inventor: Carl G. Matson, Little Rock, Ark.

[73] Assignee: Ludlow Industries, Inc., Elburn, Ill.

[21] Appl. No.: 274,737

[22] Filed: Jun. 18, 1981

[51] Int. Cl.[3] ..... B65D 88/70

[52] U.S. Cl. ..... 222/3; 222/195; 251/45; 406/137

[58] Field of Search ..... 222/195, 3; 406/137; 251/45, 61.1; 124/55

[56] References Cited

FOREIGN PATENT DOCUMENTS 951692 7/1974 Canada ..... 222/195

21999 1/1981 European Pat. Off. ..... 222/195

*Primary Examiner*—Joseph J. Rolla

*Assistant Examiner*—Frederick R. Handren

*Attorney, Agent, or Firm*—Burmeister, York, Palmatier, Hamby & Jones

[57] ABSTRACT

A blast aerator for fluidizing granular material, comprising a container connected to a supply of compressed air, an aerator valve casing having a diaphragm chamber therein, a flexible resilient diaphragm dividing the chamber into first and second portions, a conduit connected between the container and the first portion, an air blast outlet connected to an outlet port in the first portion, the diaphragm including a valve member initially closing the port by the resilience of the diaphragm, a bleed opening in the diaphragm for pressurizing the second portion when the first portion is pressurized, and a control valve for opening and closing a vent outlet from the second portion, the control valve when closed allowing pressurization of the second portion, and, when open, exhausting the pressure therefrom, whereupon the pressure in the first portion opens the valve member and quickly releases the compressed air from the container to produce an air blast through the outlet.

20 Claims, 7 Drawing Figures

BLAST AERATOR FOR FLUIDIZING GRANULAR MATERIAL

FIELD OF THE INVENTION

This invention relates to blast aerators for quickly releasing a volume of compressed air to produce a blast of air, which may be directed into a bin, tank or other receptacle to fluidize powdered or other granular material therein, so that the granular material will flow freely out of the receptacle. Blast aerators are also useful for dislodging or moving difficult granular materials in other situations where they tend to accumulate, rather than flowing freely.

BACKGROUND OF THE INVENTION

The present applicant has invented previous blast aerators, also referred to as quick-release aerators, as disclosed in the applicant's U.S. Pat. Nos. 3,788,527, issued Jan. 29, 1974, and 3,915,339, issued Oct. 23, 1975. In the aerators of such patents, a considerable volume of compressed air is stored in a tank and is quickly released by the opening of a piston valve, to produce an air blast. The piston valve is movable in a cylinder and is initially closed by air pressure in the cylinder, but is quickly popped open when the air pressure is exhausted from the cylinder by the reversal of a three-way control valve.

OBJECTS OF THE INVENTION

One object of the present invention is to provide a new and improved blast aerator which is highly effective, yet less complex and more economical than prior blast aerators.

A further object is to provide a new and improved blast aerator which may utilize a simple two-way control valve, rather than a three-way valve.

Another object is to provide a new and improved blast aerator, in which the accumulator tank and the quick release aerator valve may be separate modules, for greater economy and flexibility, and to enable the weight of the tank to be supported separately from the aerator valve.

A further object is to provide a new and improved blast aerator which will have an extremely long service life, with a minimum of maintenance.

SUMMARY OF THE INVENTION

To achieve these and other objects, the present invention may provide a blast aerator, comprising a container having a compressed air inlet adapted to be connected to a compressed air line or the like, to supply compressed air to the container, an aerator valve casing having a diaphragm chamber therein, divided into first and second portions by a flexible resilient diaphragm, a conduit connected between the container and the first chamber portion, an air blast outlet connected to an outlet port in the first chamber portion, the diaphragm including a valve member initially closing such port, bleed means between the first and second chamber portions for pressurizing the second portion when the first portion is pressurized, a vent outlet from the second chamber portion, and a control valve for opening and closing the vent outlet, the control valve when closed allowing pressurization of the second chamber portion, and, when open, exhausting the pressure therefrom, whereupon the pressure in the first chamber portion acts upon the diaphragm to open the valve member for quickly releasing the compressed air from the container to produce an air blast through the outlet.

The valve member may be biased toward its closed position by the resilience of the diaphragm. The bleed means may take the form of a bleed opening extending through the diaphragm between the first and second chamber portions. The communication afforded by such bleed means may be substantially more restricted than the exhaust communication afforded by the control valve.

The bleed means may also be in the form of a passage in the aerator valve casing, or external to the aerator valve casing.

The aerator valve and the container may be separate modules, and the conduit therebetween may be in the form of a pipe of adequate size.

BRIEF DESCRIPTION OF THE DRAWINGS

Further objects, advantages and features of the present invention will appear from the following description, taken with the accompanying drawings, in which.

DESCRIPTION OF ILLUSTRATIVE EMBODIMENTS

Figure 1:
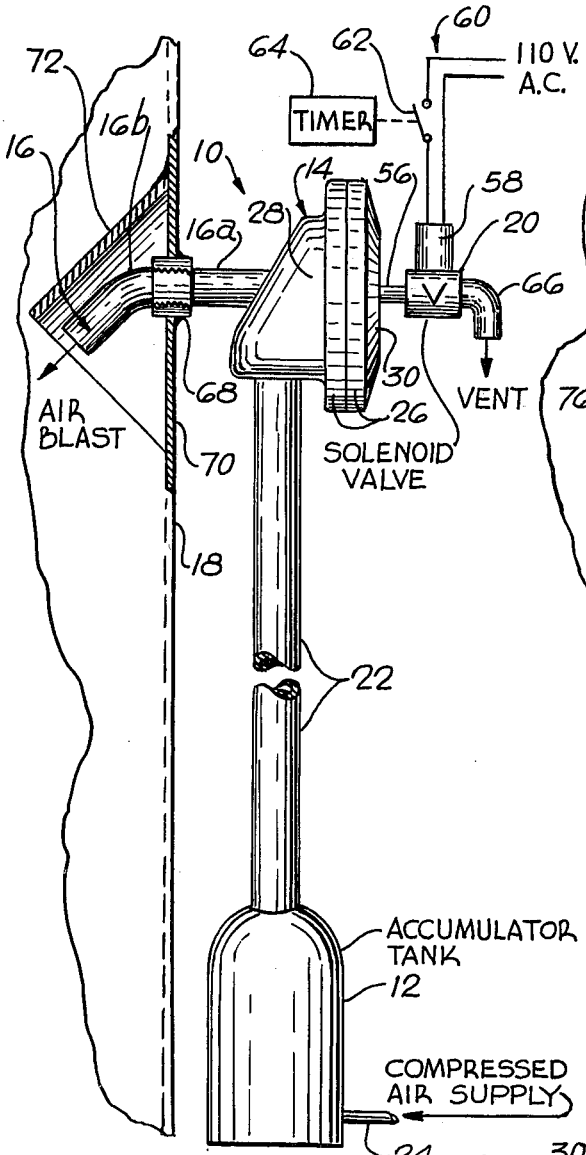
FIG. 1 is a partially diagrammatic elevational view, partly in section, showing a blast aerator to be described as an illustrative embodiment of the present invention.

As just indicated, FIG. 1 illustrates a blast aerator 10, comprising an accumulator tank or container 12 for storing a considerable volume of compressed air, to be quickly released by an aerator valve 14, for producing a strong air blast through an outlet pipe 16 into a bin, tank, silo or other receptacle 18 for holding a powdered or other granular material. The air blast fluidizes and dislodges the granular material so that it will flow freely out of the receptacle 18. The aerator valve 14 is controlled by valve means 20, shown as to a two-way solenoid valve, connected to the aerator valve 14.

As shown, the accumulator tank or container 12 and the aerator valve 14 are separate modules, although they could be combined into one module. The aerator 10 includes conduit means 22 connected between the tank 12 and the aerator valve 14, such conduit means being shown as a pipe of adequate size. It is advantageous to provide the tank 12 as a separate module, so that the weight of the tank can be supported separately from the aerator valve 14. For example, the tank 12 may be supported on the ground or some other supporting means in the vicinity of the receptacle 18. The tank 12 has an inlet, shown as a pipe 24, adapted to be supplied with compressed air. Thus, the inlet pipe 24 may constitute a branch or the terminal end of an air line, connected to an air compressor or some other source of compressed air, capable of filling and pressurizing the accumulator tank 12 with a considerable volume of compressed air. The pipe or conduit 22 transmits the compressed air to the aerator valve 14.

Details of the aerator valve 14 are shown in FIGS. 3–6. As shown, the aerator valve 14 comprises a valve casing 26, which in this case is made in two parts, a valve body 28 and a cover 30. Both parts 28 and 30 may be made as metal castings, or in any other suitable manner. The valve cover 30 is suitably secured to the body 28, as by means of cap screws or bolts 32. A seal, shown as an O-ring 34, is provided between the body 28 and the cover 30.

Figure 3:
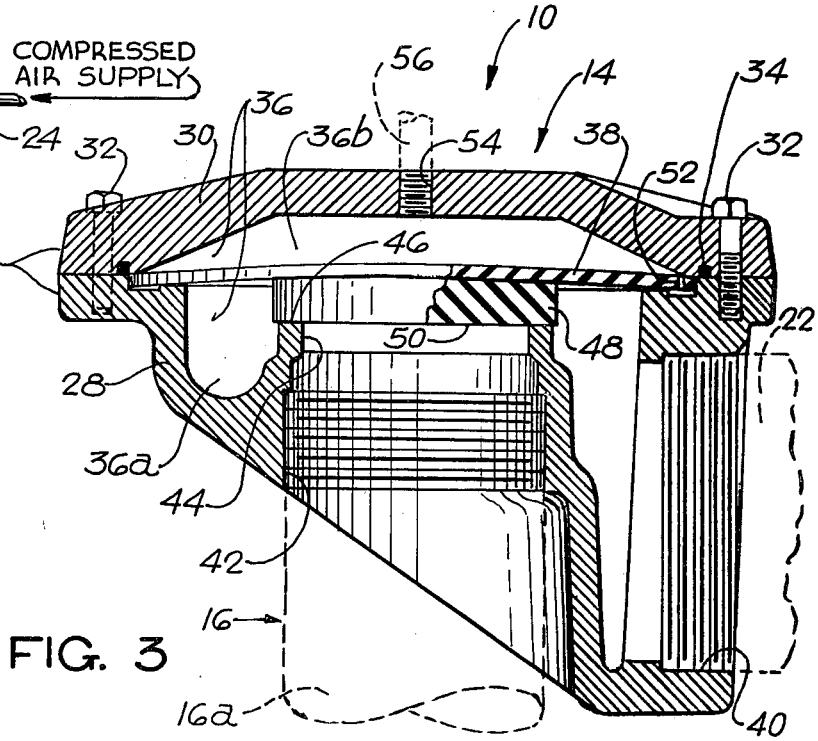
FIG. 3 is a section taken through the aerator valve of FIG. 1, showing the valve in its closed position.

As shown in FIG. 3, a diaphragm chamber 36 is provided in the valve casing 26 and is divided into first and second portions **36*a* and 36*b* by a flexible resilient diaphragm 38 which extends across the diaphragm chamber. The diaphragm 38 may be made of natural or synthetic rubber, or other suitable flexible resilient materials, such as various plastics. The diaphragm 38 is adapted to be moved or deflected in the diaphragm chamber 36, and the movement of the diaphragm has the effect of varying the volumes of the first and second diaphragm chamber portions 36*a* and 36*b***, which are on opposite sides of the diaphragm.

The valve casing 26 of FIG. 3 is formed with an air inlet opening 40 which communicates with the first diaphragm chamber portion **36*a* and is adapted to be connected to the conduit or pipe 22, extending from the accumulator tank 12. Thus the conduit 22 delivers compressed air to the first diaphragm chamber portion 36*a*. The air inlet opening 40 may be provided with internal pipe threads for receiving external pipe threads on the conduit 22**.

The aerator valve casing 26 also has an outlet opening 42 through which the air blast is delivered when the aerator valve 10 is opened. The outlet opening 42 is adapted to be connected to the outlet pipe 16, which is shown as comprising first and second sections **16*a* and 16*b*. The outlet opening 42 may have internal pipe threads, adapted to receive external pipe threads on the first section 16*a* of the outlet pipe 16**.

Figure 4:
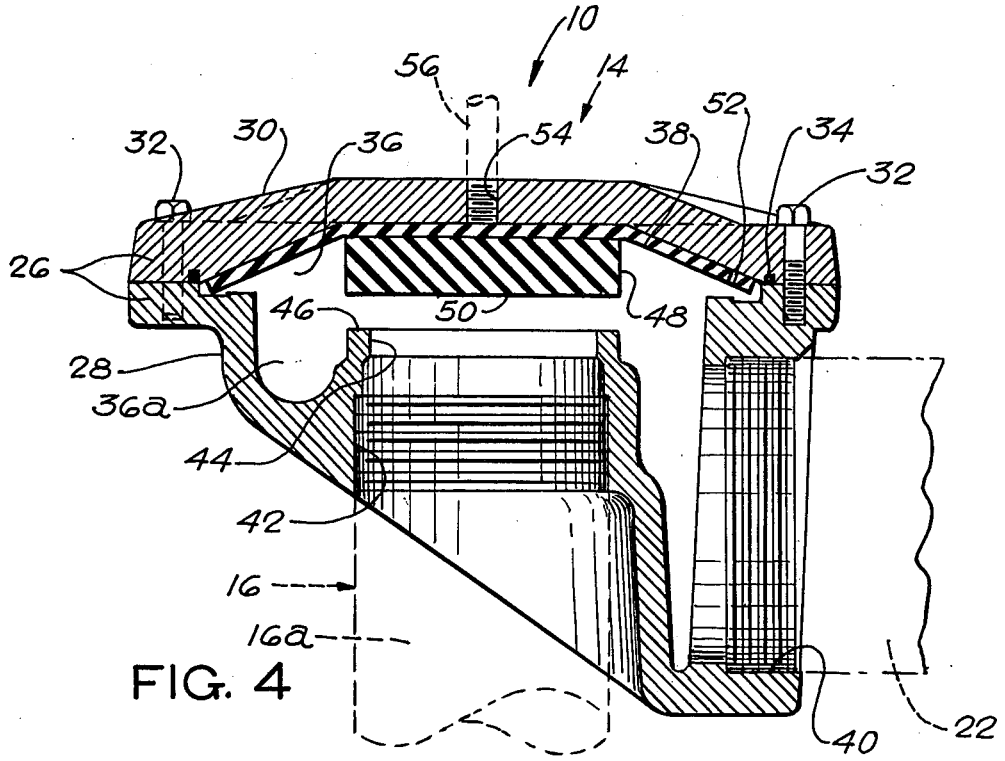
FIG. 4 is a view similar to FIG. 3, but showing the aerator valve in its open position.
Figure 5:
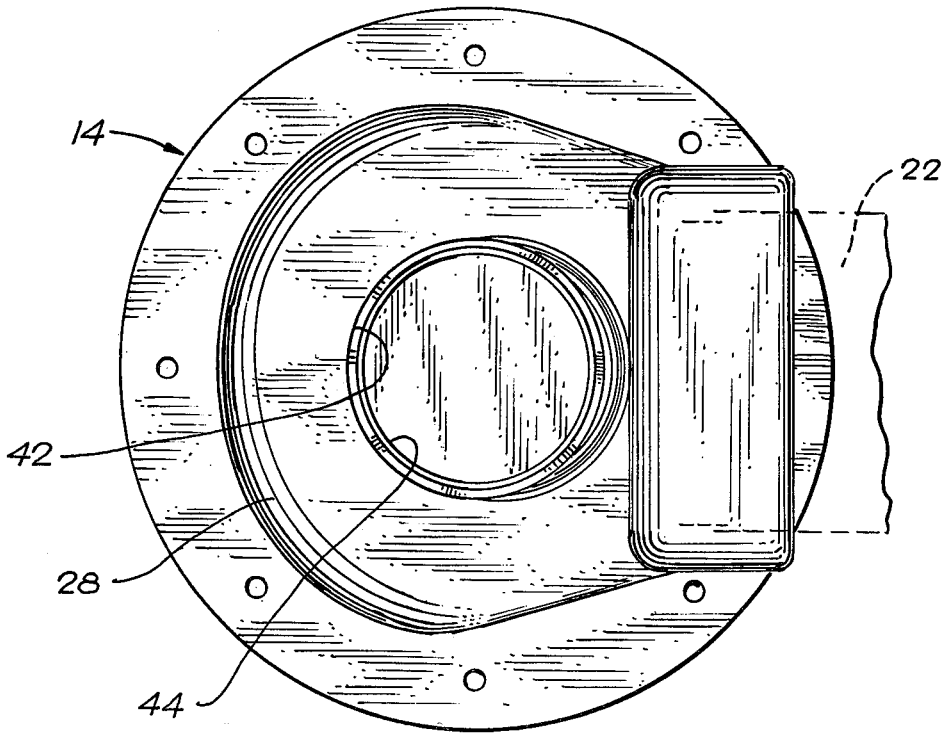
FIG. 5 is a bottom view of the aerator valve.
Figure 6:
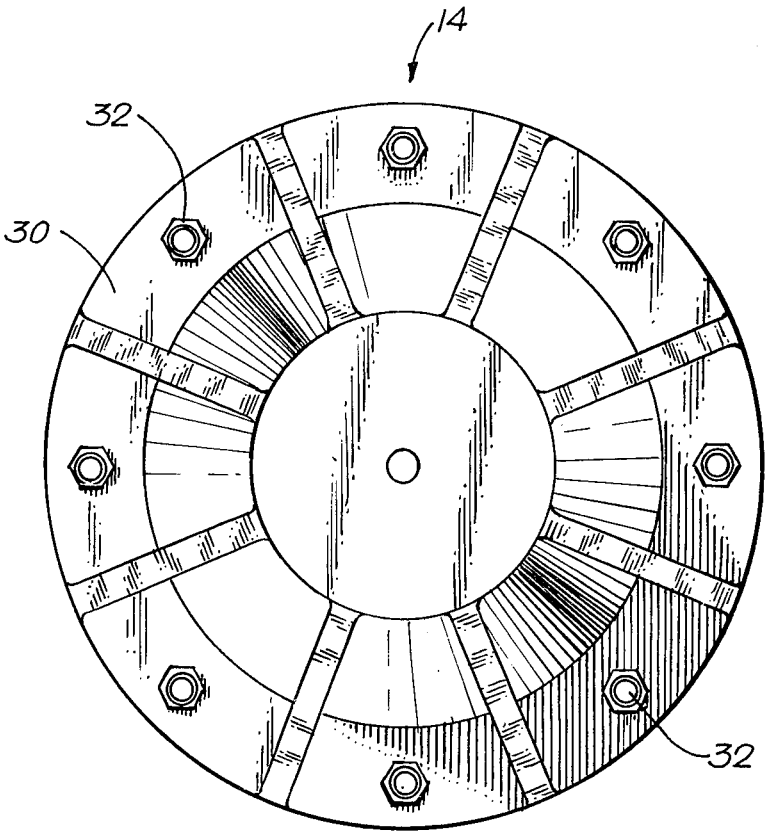
FIG. 6 is a top view of the aerator valve.
Figure 7:
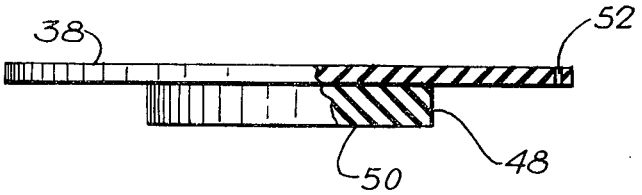
FIG. 7 is a side view, partly in section, of the diaphragm and valve member for the aerator valve.

The outlet opening 42 communicates with the first diaphragm chamber portion **36*a* through an outlet port 44, formed within an annular valve seat 46, opposite the diaphragm 38. For the purpose of selectively closing and opening the outlet port 44, the diaphragm 38 is provided with a valve member 48 having a sealing surface 50 which is engageable with the valve seat 46. The diaphragm 38 and the valve member 48 are movable between a closed position, as shown in FIG. 3, in which the valve member 48 engages the valve seat 46 and closes the valve port 44, and an open position, as shown in FIG. 4, in which the valve member 48 is moved away from the valve seat 46, so that the valve port 44 is in open communication with the first diaphragm chamber portion 36*a*. In the course of such movement, the diaphragm 38 is flexed or deflected, as shown in FIG. 4**.

Preferably, the valve member 48 is biased toward its closed position, so that the valve member is initially in such closed position, in the absence of differential air pressure. The valve member 48 is preferably biased by the resilience of the diaphragm 38. To bring this about, the position of the valve seat 46 is such that the diaphragm 38 is flexed appreciately when the valve member 48 is in its closed position, engaging the valve seat 46. The circular edge portion of the diaphragm 38 is pressed against the underside of the cover 30.

As shown in FIG. 3, the flexible resilient diaphragm 38 is in the form of a circular disc, while the valve member 48 is in the form of a smaller and thicker circular disc, secured to and projecting downwardly from the central portion of the diaphragm. If desired, the diaphragm 38 and the valve member 48 may be molded in one piece of natural or synthetic rubber, or various suitable rubber-like materials, such as various plastics. Preferably, however, the diaphragm 38 and the valve member 48 are made of different rubber or rubber-like materials and are bonded together, as by a two-stage molding operation. Preferably, the rubber material of the valve member 48 is harder than the rubber material of the diaphragm 38. For example, the valve member 48 may be made of a rubber material having a hardness of 90 durameter, while the diaphragm 38 may be made of rubber material having a hardness of 65 durameter. In this way, the durability of the valve member is increased, without sacrificing the flexibility of the diaphragm.

The aerator 10 is preferably provided with bleed means affording communication between the first and second diaphragm chamber portions **36*a* and 36*b* of the aerator valve 14, such bleed means being shown in FIG. 3 as a small bleed opening 52 extending through the diaphragm 38, between the first and second chamber portions 36*a* and 36*b*. The bleed opening 52 provides for pressurization of the second diaphragm chamber portion 36*b* when the first diaphragm chamber portion 36*a* is pressurized. More than one bleed opening may be provided through the diaphragm 38, if desired. The bleed opening may be formed in the valve casing 26, rather than in the diaphragm 38**, if desired.

As shown in FIG. 3, a vent or exhaust opening 54 may extend in the valve casing 26, out of the second diaphragm chamber portion **36*b*, such opening 54 being shown in the cover 30. The exhaust or vent opening 54 is connected to the valve means 20 by an exhaust connection, shown in FIGS. 1 and 3 as a pipe 56. In effect, the exhaust or vent opening 54 is selectively opened and closed by the valve means 20**.

As previously indicated, the valve means 20 may be in the form of a two-way solenoid valve having an operating solenoid 58 to provide for remote operation. The solenoid 58 may be energized from electrical power lines 60 through a switch 62, which may be closed periodically by a timer 64. When the switch 62 is open, the solenoid 58 is not energized, and the valve 20 is in its closed position. When the switch 62 is closed by the timer 64, the solenoid 58 is energized, and the valve 20 is actuated to its open position, so that the opening 54 in the valve cover 30 is vented or exhausted to the atmosphere, or to some other low pressure space, through the pipe 56, the valve 20, and an exhaust pipe 66. In this way, any pressure in the second diaphragm chamber portion **36*b*** is exhausted or vented to the atmosphere.

As previously indicated, the outlet pipe 16 extends from the aerator valve 14 into the receptacle 18, containing the powdered or other granular material to be aerated. The first and second sections **16*a* and 16*b* of the outlet pipe 16 are mounted in a sleeve 68 which may be in the form of a pipe coupling welded into an opening in the wall 70 of the receptacle 18. The sleeve 68 may have internal pipe threads for receiving external pipe threads on the pipe sections 16*a* and 16*b*. Within the receptacle 18, the second outlet pipe section 16*b* may curve downwardly at an inclined angle. A hood or baffle plate 72 may be mounted on the wall 70 within the receptacle 18 to protect the end of the outlet pipe 16**.

Figure 2:
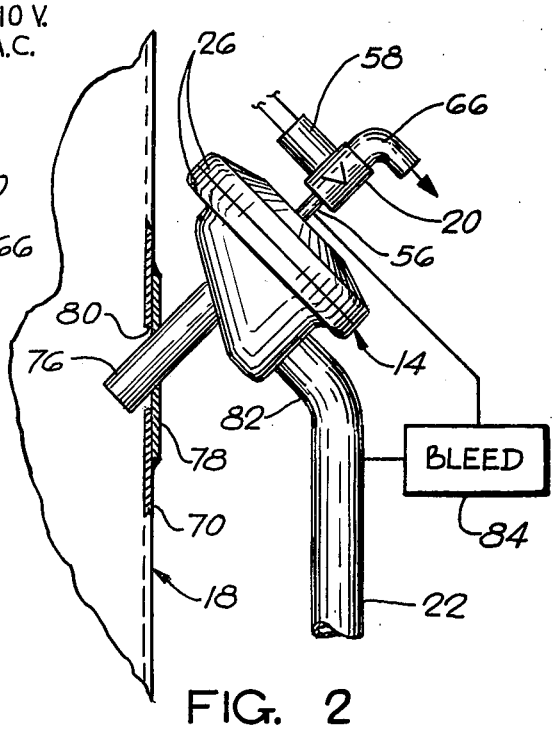
FIG. 2 is a view similar to a portion of FIG. 1, but showing a modified construction.

FIG. 2 illustrates a modified construction, in which the vent outlet pipe 16 is replaced with a straight outlet pipe 76, extending into the receptacle 18 at a downwardly inclined angle. The aerator valve 14 is correspondingly inclined. The outlet pipe 76 is shown as being welded or otherwise mounted in an opening in a mounting plate 78, which is welded or otherwise secured to the wall 70 of the receptacle 18, over an opening 80, through which the outlet pipe 76 extends into the receptacle 18. Instead of being straight, the conduit or pipe 22 is formed with an elbow or bend 82 to accommodate the inclination of the aerator valve 14.

In the construction of FIG. 3, the bleed opening 52, extending through the diaphragm 38, forms the bleed means between the first and second diaphragm chamber portions 36*a* and 36*b*. FIG. 2 illustrates a modified construction, involving bleed means 84 which may be connected externally of the aerator valve 14, such bleed means 84 being illustrated diagrammatically as being connected between the conduit 22 and the vent pipe 56. The bleed means 84 may be in the form of a bleed valve affording restricted communication, or a bleed pipe or tube of a small size, affording restricted communication. The bleed means 84 may also be in the form of a bleed passage, drilled or otherwise formed in the casing 26 of the aerator valve 14.

SUMMARY OF OPERATION

In summarizing the operation, it will be assumed that the blast aerator 10 is being put into operation with atmospheric pressure in the accumulator tank 12 and also in the first and second diaphragm chamber portions 36*a* and 36*b*. Initially, the two-way solenoid operated control valve 20 is not energized, so that the valve is in its closed position. The aerator valve member 48 is in its closed position, as shown in FIG. 3, and is biased to such position by the resilience of the rubber or rubber-like diaphragm 38.

The aerator 10 is put into operation by supplying compressed air to the accumulator tank 12 through the inlet pipe 24. Due to the volume of the tank 12, an appreciable time is required for the pressurization of the tank 12 by the compressed air. The conduit 22 transmits the compressed air to the inlet opening 40 of the aerator valve 14, so that the first diaphragm chamber portion 36*a* is pressurized, simultaneously with the pressurization of the accumulator tank 12. The bleed opening 52, extending through the diaphragm 38, transmits the compressed air to the second diaphragm chamber portion 36*b*, above the diaphragm 38, so that the second chamber portion 36*b* is also pressurized. With the valve 20 in its closed position, the air pressure cannot escape through the vent opening 54 and the pipe 56.

Thus, the diaphragm chamber portions 36*a* and 36*b* on both sides of the diaphragm 38 are pressurized, simultaneously with the pressurization of the accumulator tank 12. Accordingly, the diaphragm 38 and the valve member 48 remain in their closed positions, as shown in FIG. 3. The upper side of the diaphragm 38, exposed to the air pressure in the second chamber portion 36*b*, has a greater area than the lower side of the diaphragm 38, exposed to the pressure in the first chamber portion 36*a*. Accordingly, the air pressure on the upper side of the diaphragm 38 exerts a differential force which presses the valve member 48 against the valve seat 46.

When the accumulator tank 12 has been filled with compressed air, the aerator 10 is ready for the production of an air blast. This may be brought about by the timer 64 which closes the switch 62 to energize the solenoid 58, so as to shift the control valve 20 to its open position. The second diaphragm chamber 36*b* is thereby vented to the atmosphere, so that the compressed air escapes through the pipe 56, the valve 20 and the exhaust pipe 66. The air pressure in the first diaphragm chamber portion 36*a* remains, so that such pressure causes the diaphragm 38 to deflect and move upwardly, whereby the valve member 48 is moved to its open position, as shown in FIG. 4. In this way, the compressed air in the accumulator tank 12 is quickly released through the outlet port 44 and is discharged through the outlet pipe 16 to form a strong air blast, which is directed into the granular material in the bin or other receptacle 18. The air blast dislodges and fluidizes the grandular material, so that it will flow freely out of the receptacle 18.

With the discharge of the compressed air from the tank 12, the pressure in the first diaphragm chamber portion 36*a* drops to atmospheric pressure, or nearly so, so that the resilience of the diaphragm 38 causes the diaphragm and the valve 48 to return to their closed positions, as shown in FIG. 3. The timer 64 opens the switch 62, so that the control valve 20 returns to its closed position. The operating cycle is then repeated, as the tank 12 is being filled with compressed air.

The valve means 29 may be opened and closed in any desired or suitable manner, as by the illustrated solenoid 58, or by some other remote control means, such as an air pilot system, or manually, or in response to the attainment of a predetermined working pressure in the pipe 56. The control valve means 20 may be a simple two-way valve which is closed when the accumulator tank 12 is being filled with compressed air, and is opened when it is desired to release the stored compressed air to produce an air blast. It is not necessary to connect a compressed air line to the valve 20. The conduit 22 forms the sole conveyance of compressed air to the aerator 14. The conduit pipe 22 and the outlet pipe 16 are of ample size to provide for quick release of the compressed air from the accumulator tank 12, so that a strong air blast is produced.

It is advantageous to provide the aerator valve 14 and the tank 12 in two separate modules, so that the weight of the tank 12 can be supported separately from the aerator valve 14. Thus, the tank 12 may be supported on the ground or any other support in the vicinity of the receptacle 18 for the granular material to be aerated.

The diaphragm 38 and the valve member 48 provide highly effective and economical means for quickly releasing the compressed air from the tank 12 to form a strong air blast. The diaphragm 38 and the valve member 48 will provide a long operating life and can easily be replaced, as needed, by removing and reinstalling the cover 30. The diaphragm 38 is held captive between the cover 30 and the valve body 28, but is not clamped therebetween. This arrangement prolongs the life of the diaphragm and makes it very easy to remove and replace.

The diaphragm 38 and the associated valve member 48 have very low inertial mass, so that the valve member 48 will be moved very quickly to its open position, when the air pressure in the space 36*b* above the diaphragm 38 is exhausted to the atmoshpere by opening the control valve 20. However, the impact of the diaphragm 38 upon the underside of the cover 30 does not damage the diaphragm 38 or the cover 30, because of the small inertial mass of the diaphragm 38 and the valve member 48. This lack of damage is an important advantage of the illustrated blast aerator, as compared with prior blast aerators utilizing pistons, which often pop open quite violently, with a strong hammering effect, so that damage may be done to the piston or the cylinder in which it is mounted.

The illustrated aerator valve 14 has the additional advantage that direct access is afforded to the interior of the bin or other receptacle 18, when the cover 30 of the valve casing 26 and the diaphragm 38 are removed from the aerator valve 14. Such direct access is afforded through the outlet pipe 16 of FIG. 1, or the outlet pipe 76 of FIG. 2. Such outlet pipes are large enough to provide for the easy insertion of tools, air nozzles, air hoses or the like. Moreover, it is easy to inspect the interior of the bin or receptacle 18 visually, particularly through the straight outlet pipe 76 of FIG. 2.

I claim:

1. A blast for quickly releasing a volume of compressed air to form an aerating air blast for facilitating the flow of granular material or the like, comprising a container for holding a volume of compressed air, means for supplying compressed air to said container, an aerator valve including a valve casing, air blast outlet means connected to said valve casing, air conduit means connected between said container and said valve casing, said valve casing having a diaphragm chamber therein, a flexible resilient diaphragm extending across said diaphragm chamber and dividing said diaphragm chamber into first and second chamber portions on opposite sides of said diaphragm, said valve casing including outlet port means communicating with said first diaphragm chamber portion and connecting with said air blast outlet means, said diaphragm having a valve member for selectively closing and opening said outlet port means, said valve member and said diaphragm being movable between a closed position in which said outlet port means is closed by said valve member and an open position in which said valve member is moved away from said outlet port means to open said outlet port means, said valve member being biased toward said closed position by the resilience of said diaphragm, said valve casing having an inlet opening affording communication between said first diaphragm chamber portion and said air conduit means, said valve casing including a vent opening communicating with said second diaphragm chamber portion, said aerator valve including bleed means forming restricted communication between said first and second diaphragm chamber portions for supplying compressed air to said second diaphragm chamber portion when compressed air is supplied to said first diaphragm chamber portion from said container through said air conduit means, and valve means connecting with said vent opening and operable between closed and open positions for selectively closing and opening communication between said second diaphragm chamber portion and a low pressure exhaust connection, said valve means when closed being effective to allow said first and second diaphragm chamber portions to become pressurized with compressed air while said valve member is in its closed position, said valve means when open being effective to exhaust the compressed air from said second diaphragm chamber portion whereupon the compressed air in said first diaphragm chamber portion acts upon said diaphragm to move said valve member to its open position whereby the compressed air in said container is quickly released and discharged as an air blast from said air blast outlet means, said valve member thereupon being returned to its closed position by the resilience of said diaphragm, said container and said aerator valve being separate modules, said air conduit means being in the form of a pipe connected between said container and said aerator valve.

2. A blast aerator according to claim 1, said bleed means including a bleed opening extending through said diaphragm.

3. A blast aerator according to claim 1, said valve means including a control valve which is selectively operable between closed and open positions for selectively exhausting air pressure from said second diaphragm chamber portion.

4. A blast aerator according to claim 1, said valve means including a solenoid operated control valve which is selectively operable between closed and open positions for selectively exhausting the air pressure from said second diaphragm chamber portion.

5. A blast aerator according to claim 1, said bleed means including a bleed opening extending through said diaphragm, said valve means including a control valve which is selectively operable between closed and open positions for selectively exhausting the air pressure from said second diaphragm chamber portion.

6. A blast aerator according to claim 1, in which the communication afforded by said bleed means is substantially more restricted than the exhaust communication afforded by said valve means.

7. A blast aerator for quickly releasing compressed air to form an aerating air blast, comprising a container for holding a volume of compressed air, means for supplying compressed air to said container, an aerator valve including an aerator valve casing having an air blast outlet connection and a compressed air inlet connection, said container and said aerator valve being separate modules, air conduit means in the form of a pipe connected between said container and said compressed air inlet connection of said aerator valve casing, said aerator valve casing having a diaphragm chamber therein, a flexible resilient diaphragm extending across said chamber and dividing said chamber into first and second diaphragm chamber portions, said outlet air blast connection including an outlet port communicating with said first diaphragm chamber portion, said inlet connnection communicating with said first diaphragm chamber portion, said diaphragm including a valve member movable between a closed position in which said valve member closes said port and an open position in which said valve member is moved away from said port to open said port, said valve member being initially biased toward said closed position, said aerator including bleed means affording restricted communication between said first and second diaphragm chamber portions for pressurizing said second chamber portion when said first chamber portion is pressurized, said valve casing including vent connecting means communicating with said second diaphragm chamber portion, said vent connecting means when closed allowing said second diaphragm chamber portion to be pressurized through said bleed means, said vent connecting means when opened being effective to exhaust pressure from said second diaphragm chamber portion whereupon the air pressure in said first diaphragm chamber portion acts upon said diaphragm to move said valve member to its open position so that the air pressure in said first diaphragm chamber portion is quickly released through said outlet connection to form an aerating air blast.

8. A blast aerator according to claim 7, said bleed means including a bleed opening extending through said diaphragm.

9. A blast aerator according to claim 7, said bleed means being exterior of said valve casing.

10. A blast aerator according to claim 7, in which the communication afforded by said bleed means is substantially more restricted than the exhaust communication afforded by said vent connecting means.

11. A blast aerator according to claim 7, in which said diaphragm is made of rubber.

12. A blast aerator according to claim 7, in which said diaphragm is made of rubber-like material.

13. A blast aerator according to claim 7, in which said diaphragm is made of a first rubber material, said valve member being made of a second rubber material which has a substantially greater hardness than said first rubber material.

14. A blast aerator according to claim 7, in which said diaphragm is made of a first rubber material, said valve member being bonded to said diaphragm and being made of a second rubber material which is substantially harder than said first rubber material.

15. A blast aerator according to claim 7, in which said valve member is initially biased into said closed position by the resilience of said diaphragm.

16. A blast aerator according to claim 7, in which said diaphragm is initially flexed to provide a biasing action for urging said valve member into said closed position.

17. A blast aerator according to claim 7, including a control valve connected to said vent connecting means and operable between closed and open positions for selectively exhausting the air pressure from said second diaphragm chamber portion.

18. A blast aerator according to claim 7, said bleed means including a bleed opening extending through said diaphragm, said diaphragm being initially flexed to provide a biasing action for urging said valve member toward said closed position.

19. A blast aerator according to claim 7, said bleed means including a bleed opening extending through said diaphragm, said diaphragm being initially flexed to provide a resilient biasing action for urging said valve member into said closed position, said aerator including a control valve connected to said vent connecting means and operable between closed and open positions for selectively exhausting the air pressure from said second diaphragm chamber portion, the communication afforded by said bleed opening being substantially more restricted than the exhaust communication afforded by said control valve.

20. A blast aerator for quickly releasing a volume of compressed air to form an aerating air blast for facilitating the flow of granular material or the like, comprising a container for holding a volume of compressed air, means for supplying compressed air to said container, an aerator valve including a valve casing, air blast outlet means connected to said valve casing, air conduit means connected between said container and said valve casing, said valve casing having a diaphragm chamber therein, a flexible resilient diaphragm extending across said diaphragm chamber and dividing said diaphragm chamber into first and second chamber portions on opposite sides of said diaphragm, said valve casing including outlet port means communicating with said first diaphragm chamber portion and connecting with said air blast outlet means, said diaphragm having a valve member for selectively closing and opening said outlet port means, said valve member and said diaphragm being movable between a closed position in which said outlet port means is closed by said valve member and an open position in which said valve member is moved away from said outlet port means to open said outlet port means, said diaphragm being made of a first highly flexible resilient rubber material and being initially flexed to provide a biasing action for urging said valve member into said closed position, said valve member being bonded to said diaphragm and being made of a second rubber material which is substantially harder than said first rubber material to afford enhanced durability in repeatedly closing said port means, said valve casing having an inlet opening affording communication between said first diaphragm chamber portion and said air conduit means, said valve casing including a vent opening communicating with said second diaphragm chamber portion, said aerator valve including bleed means forming restricted communication between said first and second diaphragm chamber portions for supplying compressed air to said second diaphragm chamber portion when compressed air is supplied to said first diaphragm chamber portion from said container through said air conduit means, and valve means connecting with said vent opening and operable between closed and open positions for selectively closing and opening communication between said second diaphragm chamber portion and a low pressure exhaust connection, said valve means when closed being effective to allow said first and second diaphragm chamber portions to become pressurized with compressed air while said valve member is in its closed position, said valve means when open being effective to exhaust the compressed air from said second diaphragm chamber portion whereupon the compressed air in said first diaphragm chamber portion acts upon said diaphragm to move said valve member to its open position whereby the compressed air in said container is quickly released and discharged as an air blast from said air blast outlet means, said valve member thereupon being returned to its closed position by the resilience of said diaphragm.

* * * * *